United States Patent [19]

Altemark et al.

[11] 4,439,135

[45] Mar. 27, 1984

[54] PROCESS FOR THE OPERATION OF PREMIXTURE BURNERS AND BURNER FOR CARRYING OUT THE PROCESS

[75] Inventors: Detlef Altemark, Dorsten; Hans Sommers, Essen; Manfred Weid, Haltern, all of Fed. Rep. of Germany

[73] Assignee: Ruhrgas Aktiengesellschaft, Essen, Fed. Rep. of Germany

[21] Appl. No.: 160,892

[22] Filed: Jun. 19, 1980

[30] Foreign Application Priority Data

Jun. 29, 1979 [DE] Fed. Rep. of Germany ..... 2926278

[51] Int. Cl.[3] ..... F23D 13/00

[52] U.S. Cl. ..... 431/2; 431/158; 431/349; 431/354

[58] Field of Search ..... 431/2, 158, 349, 350, 431/353, 354, 4, 12

[56] References Cited

U.S. PATENT DOCUMENTS

| | | | |
|---|---|---|---|
| 2,753,925 | 7/1956 | Campbell et al. | 431/353 |
| 3,352,347 | 11/1967 | Robson | 431/349 |
| 3,485,566 | 12/1969 | Schoppe | 431/158 |
| 3,574,506 | 4/1971 | Locke | 431/349 |
| 3,880,571 | 4/1975 | Koppang et al. | 431/177 X |
| 3,907,488 | 9/1975 | Takahashi et al. | 431/2 |
| 3,914,093 | 10/1975 | Proctor | 431/354 X |
| 4,021,188 | 5/1977 | Yamagishi et al. | 431/158 |
| 4,113,417 | 9/1978 | Deruelle | 431/12 X |
| 4,152,108 | 5/1979 | Reed et al. | 431/354 X |

*Primary Examiner*—Samuel Scott
*Assistant Examiner*—Margaret A. Focarino
*Attorney, Agent, or Firm*—Martin A. Farber

[57] ABSTRACT

A process for the operation of premixing burners, and a burner for carrying out the process, with gaseous fuels or vaporized fuels for the production in a mixer pipe of a homogeneous mixture comprising the fuel, the quantity of combustion air required for the complete combustion of the fuel and additional cooling gas as needed for combustion between 1,100° and 1,700° C. This mixture flows to a burner head with a widening cross-section and a burner plate at the wide end where it is burnt at a central main flame bore arranged at the burner plate and several surrounding support flame bores. The flames then pass through a converging burner mouth and a downstream flame guard which protects the flames against the entrance of air or flue gas from the environment, against cooling and against heating until the completion of combustion. The burner mouth and the flame guard are coated by a non-catalytic material. The waste gas at the outlet of the flame guard contains very little nitrogen oxides and is therefore highly suited for further utilization such as foodstuff drying.

6 Claims, 2 Drawing Figures

PROCESS FOR THE OPERATION OF PREMIXTURE BURNERS AND BURNER FOR CARRYING OUT THE PROCESS

The invention relates to a process for the operation of premixture burners under normal or elevated pressure with gaseous fuels, or with fuels which are liquid at normal temperature and completely vaporized before combustion, at low combustion temperatures, forming waste gases having a low content of harmful substances, as well as to a burner for carrying out the process.

In the combustion of gaseous and liquid fuels, inter alia the nitrogen oxides NO and $NO_2$, together called $NO_x$, occur as harmful substances in the waste gas. These harmful substances pollute the air and in some furnace systems can have negative effects upon the material situated in the furnace or that coming into contact with the burner exhaust gases. Therefore one endeavours to keep the $NO_x$ content in the waste gas as low as possible. The causes of $NO_x$ formation are known, and several measures are also known for reducing the $NO_x$ content in the waste gas, as for example:

Reduction of the combustion temperature by direct flame cooling, for example, water injection of cooled combustion surfaces;

combustion in two or more stages;

waste gas re-circulation by conducting the waste gases past the flame by means of return passages or special burner designs;

super-stoichiometric combustion.

Nevertheless heretofore no high-power burner for industry or commerce is known which has an extremely low $NO_x$ content in the waste gas.

It is the problem and object of the invention to set forth a process for the operation of pre-mixture burners in which fuels in gas and/or vapor form can be burned completely at normal or elevated pressure and low combustion temperature with formation of waste gases with extremely low $NO_x$ contents, and to produce a burner for carrying out this process which permits high burner outputs at low combustion temperatures and with the flame thereof burning stably over a great range of outputs.

According to the invention there is provided a process for the operation of pre-mixture burners under normal or elevated pressure with gaseous fuels, or with fuels which are liquid at normal temperature and completely vaporized before combustion, at low combustion temperatures, forming waste gases having a low content of harmful substances, wherein a homogeneous mixture, comprising the fuel in gaseous or vaporized form, a combustion air quantity required for the complete combustion of the fuel and a cooling gas quantity serving for the setting of the combustion temperature of 1100° C. to 1700° C., preferably 1200° C. to 1300° C., is fed to the burner, wherein the combustion takes place in at least one central main flame which is surrounded by several support flame rings, and the flame which occurs is protected against access of ambient air and/or waste gas and against cooling or heating until the completion of burning.

Further by a feature of the invention air and/or waste gas and/or water vapor is used as a cooling gas.

Still further by the invention the quantity of the cooling gas amounts to 20% to 600% of the quantity of air required for the complete combustion of the fuel.

Yet further in accordance with the invention an apparatus is provided for carrying out the above process comprising a mixer pipe (1) with supply conduits for the fuel (2), for the combustion air (3) and for the cooling gas (4), a burner head (5) adjoining the mixer pipe (1), the cross-section (6) of which burner head, at the connection to the mixer pipe (1), is 1.1 to 3.8 times, preferably 1.8 to 2.7 times, the cross-section of the mixer pipe and the cross-section of which thereafter widens to 2.0 to 6.8 times, preferably to 3.2 to 4.8 times, the cross-section of the mixer pipe, a burner plate (7) disposed at the widened end of the burner head (5) and having at least one main flame bore (8) which extends parallel to the burner axis, and having several small support flame openings (9) which extend in several concentric rings around the main flame bore (8) and of which at least the support flame openings in the outermost ring extend at an angle of 10° to 70°, preferably 25° to 45°, to the burner axis, and a burner mouth (10) of equal cross-section adjoining the burner plate (7), which mouth is initially formed cylindrically and then narrows to 1.4 to 4.9 times, preferably 2.3 to 3.5 times, the cross-section of the mixer pipe. The flames than pass through a flame guard (11) which surrounds and protects the flame against the entrance of air or flue gas from the environment, against cooling and heating until completion of the combustion. The inner diameter of the flame guard corresponds to the maximum external diameter of the freely burning flame therein.

Further according to a feature of the invention the flame guard (11) comprises a cylindrical tube.

Still further by the invention the flame guard (11) comprises an initially conically widened and then following cylindrical tube.

The invention also features the burner mouth (10) and the flame guard (11) forming a part of the combustion chamber which does not eliminate or conduct away useful heat.

Still further in accordance with another feature of the invention the burner mouth (10) and the flame guard (11) are internally lined with a catalytically inert material.

According to a still additional cooperative feature of the invention the burner plate (7), the burner mouth (10) and the flame guard (11) are lined with or are produced from ceramic material.

With the above and other objects and advantages in view, the present invention will become more clearly understood in connection with the detailed description of a preferred embodiment, when considered with the accompanying drawings, of which:

$NO_x$ forms on the one hand from the nitrogen bound in the fuel and on the other hand thermally from free nitrogen which is present especially in air and possibly also in the fuel, for example in natural gas. The thermal $NO_x$ formation takes place especially at high combustion temperatures, for example such as from about 1600° C. in the case of natural gas. A low combustion temperature and thus a low $NO_x$ content in the waste gas are achieved according to the process according to the invention in the case of fuels with a low proportion of bound nitrogen by homogeneously mixing of the combustion air-fuel mixture before combustion with a cooling gas. This cooling gas can be air, waste gas, water vapor or a mixture of two or all three of these components. In order to achieve for example theoretically 1 ppm $NO_x$ in the waste gas (parts per million in relation to air-free and dry waste gas), at a pressure of 1 bar and when air at 20° C. is used as the cooling gas, a setting of the theoretical combustion temperature of 1330° C. is necessary.

Figure 1:
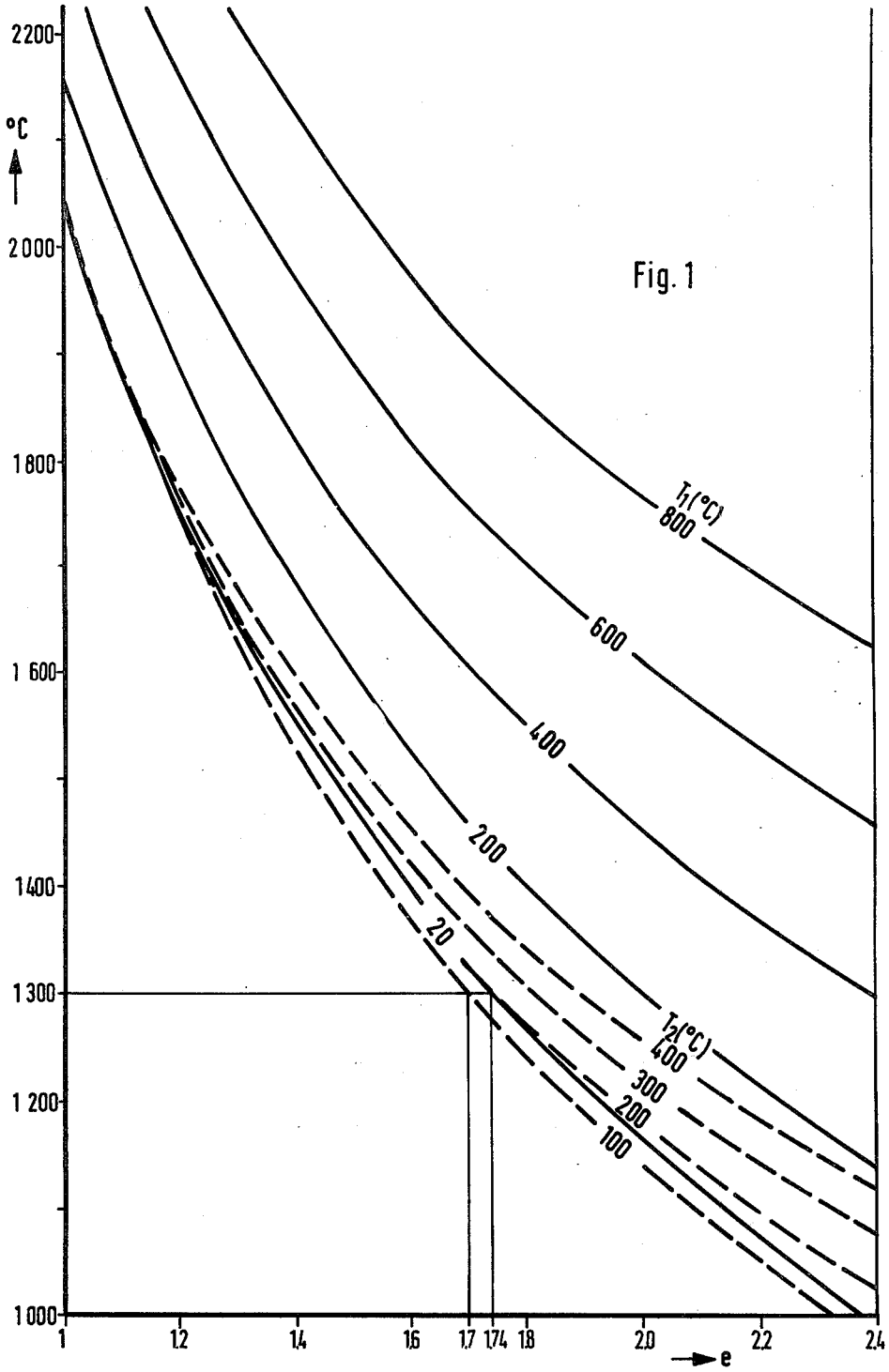
FIG. 1 is a graphical illustration of combustion temperature vs. mass flow ratio for different conditions.

In FIG. 1 the dependency of the theoretical combustion temperature upon the mass flow ratio e at various air temperatures $T_1$ and waste gas temperatures $T_2$ is illustrated by the example of the burning of natural gas.

The mass flow ratio e is defined as the ratio of a first mass current, which is composed of a fuel quantity, a combustion air quantity and a cooling gas quantity, to a second mass flow which is composed of the same fuel quantity and the combustion air quantity necessary for stoichiometric combustion. The theoretical combustion temperature results, without heat exchange with the environment and with complete combustion of the fuel into $CO_2$ and $H_2O$, from the heating value of the fuel and the enthalpies of the substances supplied to the burner. The enthalpies are determined by quantities, temperatures and specific heat capacities of the substances.

In FIG. 1 the continuous curves of a first family of curves shown what combustion temperatures are achieved in dependency upon the mass flow ratio e if the fuel natural gas before combustion is mixed homogeneously solely with air with the temperature $T_1$ provided in each case on the continuous curves, that is to say if in the above-defined mass flow ratio, the first mass flow contains no returned waste gas as the cooling gas and air quantities of different sizes are used alone as cooling gas.

The dashed line curves of a second family of curves in FIG. 1 show the combustion temperatures occurring in dependency upon the mass flow e when the first mass flow of the above-defined mass flow ratio contains an air quantity which is equal to the air quantity in the second mass flow required for stoichiometric combustion, and if the first mass flow contains returned waste gas as the cooling gas. For the dashed-line curves the supplied combustion air has a temperature of 20° C. and the waste gas serving as the cooling gas has the temperature $T_2$ provided in each case on the dashed-line curves. The dashed-line curves represent only an example for the determination of the theoretical combustion temperature and of the mass flow ratio. For the sake of clarity, representation of the corresponding curves for the cases where water-vapor of different temperatures is used as the cooling gas or a cooling gas with different temperature is mixed with combustion air of temperatures other than 20° C., has been omitted. Such curves can be calculated and represented using the specific data published in relevant handbooks and the like.

It can be seen from FIG. 1 that to achieve a theoretical combustion temperature for example of 1300° C. using only combustion air of 20° C. simultaneously as a cooling gas (see the lower-most continuous curve) the mass flow ratio e is equal to 1.74, while when combustion air of 20° C. is used in a mixture with waste gas of 100° C. as the cooling gas (see the lowermost dashed-line curve) the mass flow ratio e is equal to 1.70.

In experiments which were carried out both in the laboratory and in industrial use, $NO_x$ values of 1.5 ppm (air-free, dry) were achieved using natural gas as fuel and air as combustion and cooling gas, a theoretical combustion temperature of 1300° C. being set. This shows that the theoretical values stated further above are largely achieved in practice. In the burners usual heretofore the $NO_x$ content in the waste gas on the average amounts to 50–500 ppm (air-free, dry).

With low combustion temperatures (with natural gas for example below about 1600° C.) the speed of combustion however already becomes so low that the combustion can proceed unstably and that further cooling of the flame can easily lead to the stabilizaton of combustion intermediate products such as CO and formaldehyde. These difficulties are avoided if the burner is formed in accordance with the invention.

The burner according to the invention is suitable for all fuels which are present in the gaseous or vaporized form before combustion and can be mixed homogeneously with the combustion air and the cooling gas. The burner can be operated either under normal pressure or under elevated pressure.

Figure 2:
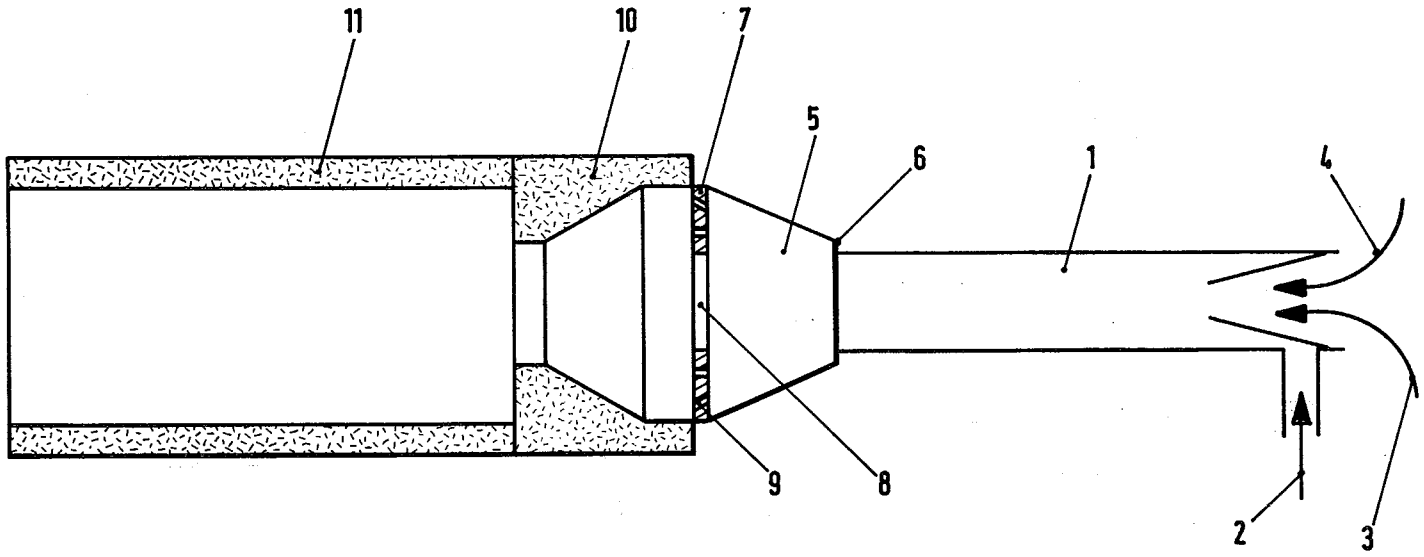
FIG. 2 is a schematic cross-sectional view of a burner according to the present invention.

An example of an embodiment of the burner according to the invention is represented in FIG. 2. The process according to the invention and the burner will be described below.

Fuel 2, combustion air 3 and cooling gas 4 must be fed to the mixer pipe or mixer tube 1. The combustion air is fed to the mixer pipe for example through a blower, which is not illustrated in FIG. 2.

If air is used as a cooling gas, this air is fed in the same way. If waste gas or water vapor serve as the cooling gas, these can be conveyed in common together with the combustion air by a blower, if their temperatures and the temperature of the air—cooling gas mixture is permissible for the blower. Otherwise the cooling gas like the fuel can be fed directly to the mixer pipe, for example by injector action. To shorten the mixer pipe the fuel can also be supplied before the blower.

The mixer pipe 1 is adjoined by the burner head 5, the cross-section 6 of which at the connection to the mixer pipe 1 is for example twice the cross-section of the mixer pipe.

By this sudden transition to a larger flow cross-section a break-away edge is formed for the flow. The burner head 5 widens thereafter conically for example to 4.5 times the mixer pipe cross-section. Instead of the conical form of the burner head circumference as illustrated, curved peripheral or circumference forms are also possible. At the end of the burner head there is mounted a burner plate 7 which has a large main flame bore 8 and several small bores 9 which are arranged in several concentric rings around the main flame bore 8 and serve for the formation of the support flames. According to the size of the burner head several main flame bores can be present in the burner plate. Moreover the small bores 9 can be replaced by corresponding openings of slot form. The burner plate can be made either of metal or of ceramic material. The intervals or spacings of the support flame bores 9, which together have a free or open cross-secton somewhat smaller than that of the main flame bore 8, are selected so that they guarantee a satisfactory ignition from the outermost support flames to the main flame and mutual stabilization of the support flames. While the main flame bore 8 extends parallel to the burner axis, at least the support flame bores 9, which are disposed in the outermost ring, are inclined at an angle, for example, of about 40° relative to the burner axis. The outermost support flame ring is stabilized in this way by return flow on the cylindrical wall of the burner mouth 10, which cylindrical wall adjoins the burner plate 7.

The burner mouth 10 is made cylindrical only for a short distance and then downstream tapers conically, for example to 2.9 times the mixer pipe cross-section. The circumferential surface of the burner mouth can be made either conical, as illustrated in FIG. 2, or with outward curvature, analogously to the burner head. The burner plate 7 can also be made conical or domed, instead of the flat form as illustrated.

Figure 3:
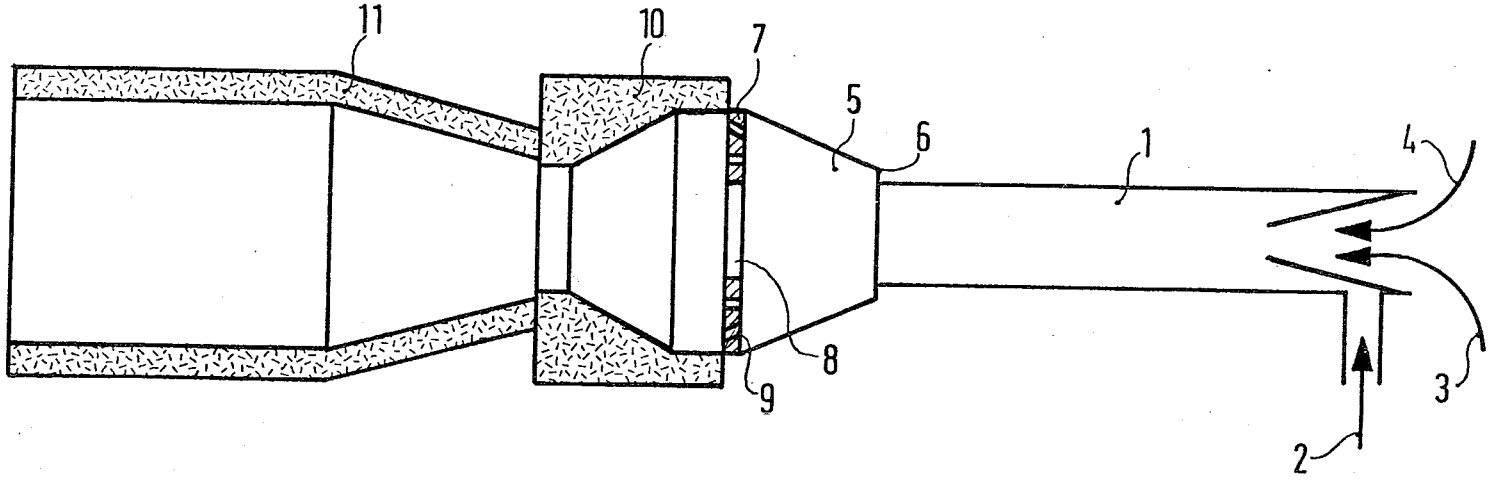

In order to protect the flame which occurs against cooling from the exterior and to prevent undesired penetration of extraneous gases into the flame or combustion zone, wich would have the initially described negative results, the burner mouth 10 is connected with a flame guard 11. In FIG. 2 this flame guard is represented as a cylindrical tube, the inner diameter of which corresponds to the maximum external diameter of the freely burning flame. Another advantageous embodiment of the flame guard (FIG. 3) is a pipe having an upstream portion which is conically widened and a downstream portion which is cylindrical, which pipe thus is adapted to the flame form. The flame guard is of such formation that it does not hinder or constrict the flame. The flame guard 11 prevents the flame from being cooled further by contact with air and/or waste gas from the surroundings and thus hindered from complete combustion. It has proved advantageous to line the burner mouth 10 and the flame guard 11 internally with a catalytically inert material, or in the case of low ambient temperatures, with a thermal insulation, for example ceramics. The task of a flame guard can also be fulfilled by a combustion chamber which does not eliminate or take away usable heat and in which the flame can burn out completely.

With the process according to the invention it is possible for the first time to burn homogeneous mixtures of the stated kind with very high mass flow ratios, operationally reliably and with a low level of harmful substances. By adjustment of the mass flow ratio in the above-described manner it is possible to set a desired combustion temperature. Due to the fact that the mixing of the burner gases with extraneous gases, for example air or waste gas, which are present in the environment of the burner, is most extensively avoided, the flame temperature remains so homogeneous that the thermal $NO_x$ formation corresponds largely to the $NO_x$ formation at the theoretical combustion temperature.

The burner according to the invention, despite a most simple construction, is distinguished inter alia by a quiet, stable combustion with a low level of harmful substances over a large output range.

The possibilities of use for the subject matter of the invention are extraordinarily versatile. These include for example the production of waste gas—air mixtures for heating and drying foodstuffs, the heating of boilers and industrial furnaces of the most various kinds and the generation of propellent gas for gas turbines. In all these cases the subject matter of the invention can provide a valuable contribution toward keeping the air clean, due to the unusually low $NO_x$ content in the waste gas.

While we have disclosed several embodiments or examples of my invention it is to be understood that these are given by example only and not in a limiting sense.

We claim:

1. A process for the operation of a pre-mixing burner under at least normal pressure with gaseous fuels, or with fuels which are liquid at normal temperature and completely vaporized before combustion, at low combustion temperatures, forming waste gases having a low content of noxious substances, comprising the steps of feeding to the burner a homogeneous mixture comprising a fuel in gaseous or respectively vaporized state, a combustion air quantity which is required for the complete combustion of the fuel and a cooling gas quantity serving for setting the combustion temperature of 1100° C. to 1700° C., combusting the mixture in the burner in at least one central main flame which is surrounded by several support flame rings, and protecting the arising total flame against access of ambient air and/or waste gas and against cooling or heating until burning is completed, and wherein the fuel, air and cooling gas are homogeneously mixed substantially in advance of being fed to the burner.

2. The process according to claim 1, wherein the cooling gas is air and/or waste gas and/or water vapor.

3. The process according to claim 1 or 2, wherein the quantity of the cooling as is 20% to 600% of the quantity of air required for the complete combustion of the fuel.

4. The process according to claim 1, wherein the cooling gas quantity serves for the setting of the combustion temperature of 1200° C. to 1300° C.

5. A process for the operation of a pre-mixing burner under at least normal pressure with gaseous fuels, or with fuels which are liquid at normal temperature and completely vaporized before combustion, at low combustion temperatures, forming waste gases having a low content of noxious substances, comprising the steps of feeding to the burner a homogeneous mixture comprising a fuel in gaseous or respectively vaporized state, a combustion air quantity which is required for the complete combustion of the fuel and a cooling gas quantity serving for setting the combustion temperature of 1100° C. to 1700° C., retarding the velocity of the homogeneous mixture by widening the cross-section of the stream of said homogeneous mixture, combusting the mixture in the burner in at least one central main flame which is surrounded by several support flame rings, accelerating the velocity of the arising total flame by narrowing the cross-section of said flame, and protecting the arising total flame against access of ambient air and/or waste gas and against cooling or heating until burning is completed.

6. The process according to claim 5, wherein the fuel, air and cooling gas are homogeneously mixed substantially in advance of being combusted.

* * * * *